US005643013A

United States Patent [19]

Weidler et al.

[11] Patent Number: 5,643,013

[45] Date of Patent: Jul. 1, 1997

[54] ELECTRICAL CONNECTOR

[75] Inventors: Charles Harry Weidler, Lancaster; Edward Eugene Knisley, Jr., Middletown, both of Pa.

[73] Assignee: The Whitaker Corporation, Wilmington, Del.

[21] Appl. No.: 453,128

[22] Filed: May 24, 1995

[51] Int. Cl.[6] ..... H01R 19/00

[52] U.S. Cl. ..... 439/660

[58] Field of Search ..... 439/733.1, 746–749, 439/943, 676, 79, 660

[56] References Cited

U.S. PATENT DOCUMENTS

| | | | |
|---|---|---|---|
| 3,957,337 | 5/1976 | Damiano | 439/748 |
| 4,904,212 | 2/1990 | Durbin et al. | 439/943 |
| 5,006,080 | 4/1991 | Ichitsubo et al. | 439/634 |
| 5,017,156 | 5/1991 | Sugiyama et al. | 439/607 |
| 5,030,140 | 7/1991 | Sugiyama | 439/746 |
| 5,073,130 | 12/1991 | Nakamura | 439/607 |
| 5,139,446 | 8/1992 | Costello et al. | 439/943 |
| 5,266,038 | 11/1993 | Nakamura | 439/79 |
| 5,270,599 | 12/1993 | Aoyagi et al. | 439/733.1 |
| 5,295,843 | 3/1994 | Davis et al. | 439/108 |

FOREIGN PATENT DOCUMENTS

| | | | |
|---|---|---|---|
| 0 292 144 | 11/1988 | European Pat. Off. | H01R 23/70 |

*Primary Examiner*—Gary F. Paumen

*Attorney, Agent, or Firm*—Anton P. Ness

[57] ABSTRACT

An electrical connector comprises, a housing (2), conductive contacts (3) in the housing (2) extending toward a mating end (23) on the housing (2), channels (25) in the housing (2) receiving respective contacts (3), and core pin openings (34) in the mating end (23) communicating with the channels (25), wherein the channels are formed with precision in a slender mating end (23) on the housing (2).

2 Claims, 3 Drawing Sheets

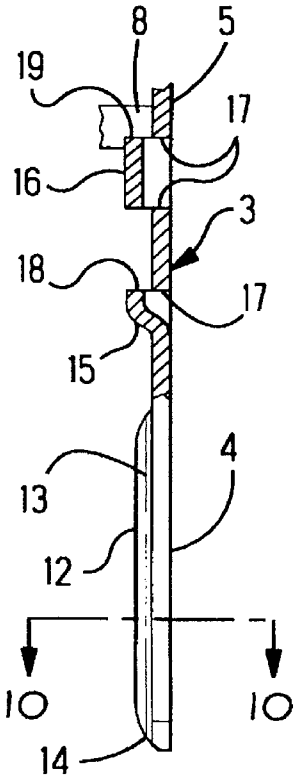
Fig. 9
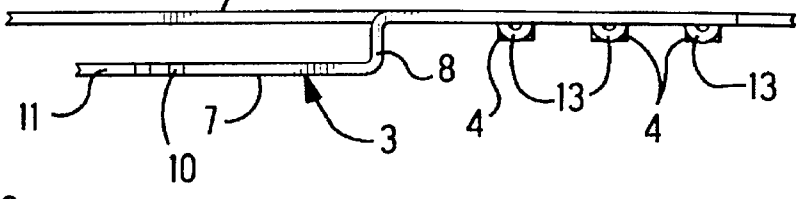
Fig. 7
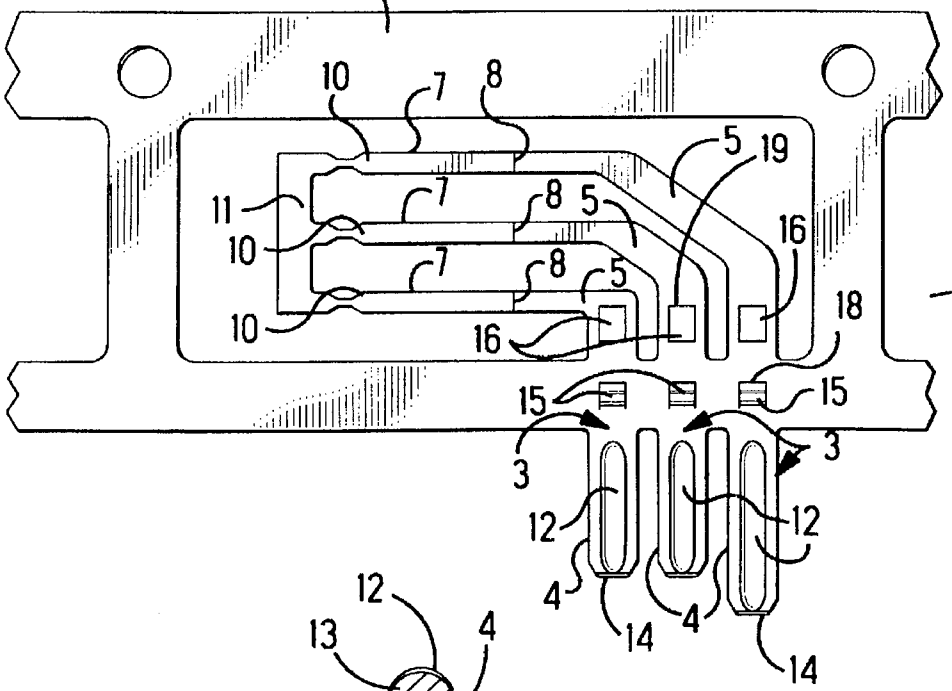
Fig. 8
Fig. 10

ELECTRICAL CONNECTOR

FIELD OF THE INVENTION

The invention relates to an electrical connector having conductive electrical contacts in an insulating housing, and more particularly, to a feature on the housing for maintaining alignment of the contacts along a thin section of the housing.

BACKGROUND OF THE INVENTION

According to U.S. Pat. No. 5,017,156, and U.S. Pat. No. 5,073,130, an electrical connector comprises, two rows of electrical contacts on opposite sides of an insulator. The insulator is a portion of an insulating housing on which the contacts are assembled. The contacts are arranged in pairs, with the contacts of each pair opposing each other and being mounted on opposite sides of the insulator.

According to U.S. Pat. No. 5,266,038, the contacts in the connector are formed with respective curved portions of different lengths. The curved portions protrude from the housing. The contacts curve toward a circuit board on which the housing is mounted.

A connector described by the prior patents has a solid insulator that separates the contacts of each pair. The contacts extend along shallow channels that are recessed in opposite sides of the insulator. The insulator is manufactured by a molding operation according to which molten plastic material is injected into a confined cavity of a molding die to become formed with the shape of the insulator. The shallow channels are formed by corresponding core pins that project into the cavity. Because the channels are shallow, the corresponding core pins are thin. The thin core pins are deflected out of position by the molten plastic material. In the completed insulator, the shallow channels that were formed by the deflected core pins are misaligned from their desired positions.

SUMMARY OF THE INVENTION

The invention pertains to a feature on an insulator on an electrical connector that assures shallow channels to be formed without being misaligned.

According to the invention, shallow channels are recessed in opposite sides of an insulator that is formed by a molding operation, and a core pin opening extends along the insulator between the channels. The channels extend along opposite sides of the core pin opening that was formed by a core pin during the molding operation. The opening enters a front face of the insulator from which the core pin was withdrawn from the insulator. The channels and the electrical contacts along the channels are wider than the core pin opening, which avoids falling of the contacts into the opening, thus maintaining the contacts precisely in position.

DESCRIPTION OF THE DRAWINGS

An embodiment of the invention will now be described by way of example with reference to the accompanying drawings, according to which:

FIGS. 7 and 8 are top and plan views of one set of electrical contacts of the connector of FIG. 1;

FIG. 9 is a partial section view of the contacts of FIGS. 7 and 8; and FIG. 10 is a section view through one of the contacts taken along lines 10—10 of FIG. 9.

DETAILED DESCRIPTION

Figure 2:
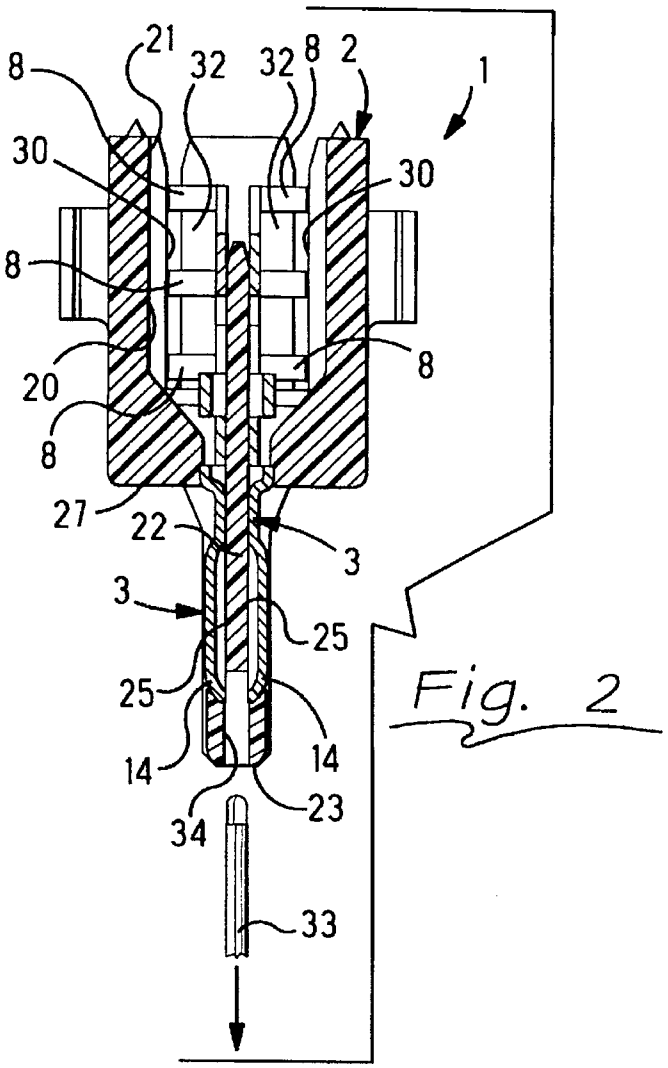
FIG. 2 is a section view taken through FIG. 1.
Figure 1:
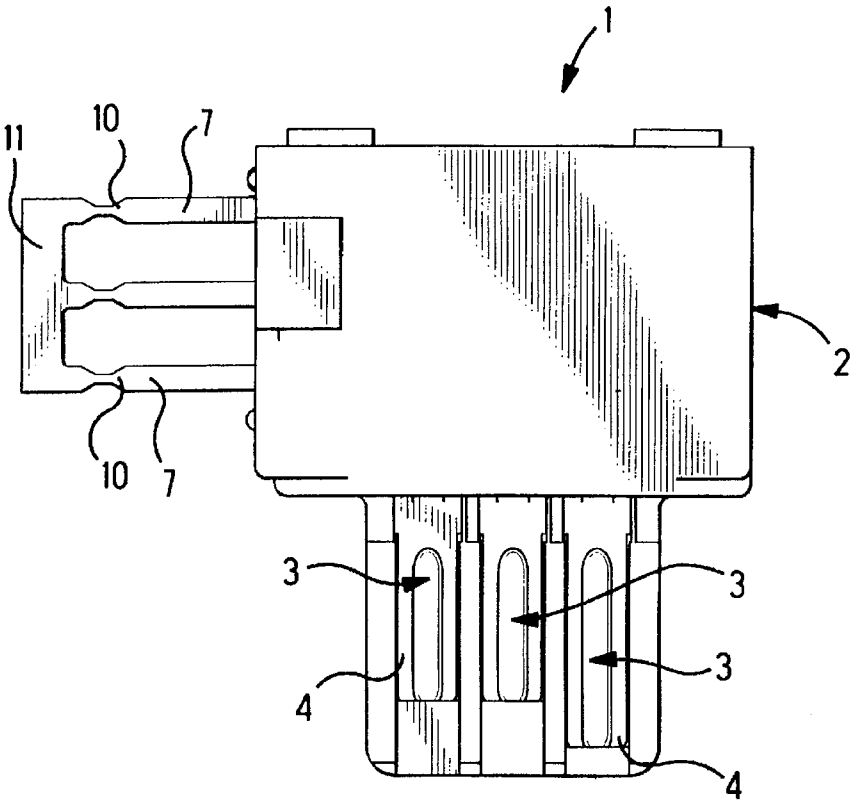
FIG. 1 is a side view of an electrical connector.

With reference to FIGS. 1 and 2, an electrical connector 1 comprises, an insulating housing 2, and multiple electrical contacts 3 assembled to the housing 2.

With reference to FIG. 8, one set of three of the electrical contacts 3 is shown. The contacts 3 are coplanar with one another, with one of the contacts 3 being longer than the others. The connector 1 comprises two sets of the contacts 3 in the housing 2. The construction of one set of the contacts 3 will now be described.

With reference to FIGS. 7–10, each of the contacts 3 is of one piece construction, stamped and formed from a thin sheet of metal having a plane of thickness. Each contact 3 comprises, an elongated mating portion 4, a curved or angled central portion 5 and an elongated terminal 7. The terminal 7 has an offset 8 created by a bend in the contact 3 rearward of the central portion 5. The offsets 8 on the contacts 3 are in coplanar alignment. The terminal 7 extends perpendicular to the axis of the mating portion 4. The central portion 5 is curved to join the mating portion 4 with the terminal 7. The contacts 3 are initially joined to a carrier strip 9 that is subsequently cut away and removed. Tips 10 of the terminals 7 are joined by a second carrier strip 11 that is subsequently cut away and removed.

Each contact 3 has a raised contact surface 12 formed by an axially extending arch 13 in the mating portion 4. A front of each arch 13 is sloped to a tapered tip 14 on the mating portion 4. Rearward of the arch 13 on each contact 3, are spaced apart, front projection 15 and a rear projection 16. The projections 15, 16 are defined by punching slits 17 through the thickness of the contact 3. The slits 17 partially circumscribe the peripheries of the respective projections 15, 16 and define rear facing edges 18, 19 on the projections 15, 16.

The front projection 15 is bent out of the plane of thickness of the corresponding contact 3. The front projection 15 is curved to impart stiffness. The front projection 15 has a rear facing edge 18 that projects outwardly. The rear projection 16 is bent out of the plane of thickness, and rear facing edge 19 projects outwardly therefrom.

With reference to FIGS. 1–6, the housing 2 is of unitary plastic construction fabricated by molding a plastic material. A contact receiving cavity 20 is in an interior of the housing 2. A rear 21 of the housing 3 is open. A thin insulating divider 22, FIGS. 2 and 3, on the housing 2 extends within the cavity 20 and projects forwardly outward of the housing 2 to a front mating end 23. Raised slender walls 24 project outwardly from the surfaces on opposite sides of the slender divider 22. The walls 24 define sides of contact receiving channels 25 that extend along the surfaces on the opposite sides of the divider 22. Each channel 25 extends toward the mating end 23. Each channel 25 extends into a pocket 26 on the mating end 23 at a front of the channel 25. Each channel 25 extends through a front wall 27 on the housing 2, and communicates with the cavity 20 in the housing 2. Respective channels 25 communicate with larger contact receiving openings 28 in the front wall 27 of the housing 2.

Figure 3:
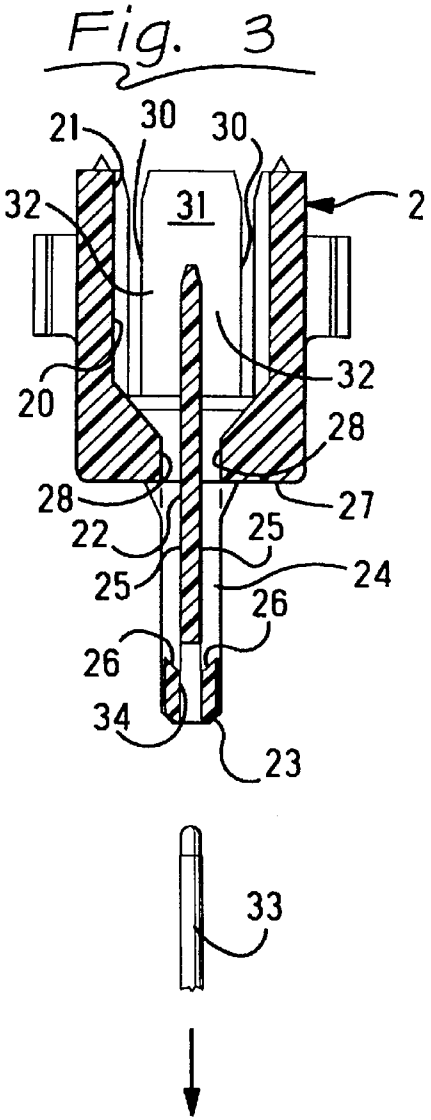
FIG. 3 is a view similar to FIG. 2, illustrating a housing of the connector shown in FIG. 1.
Figure 6:
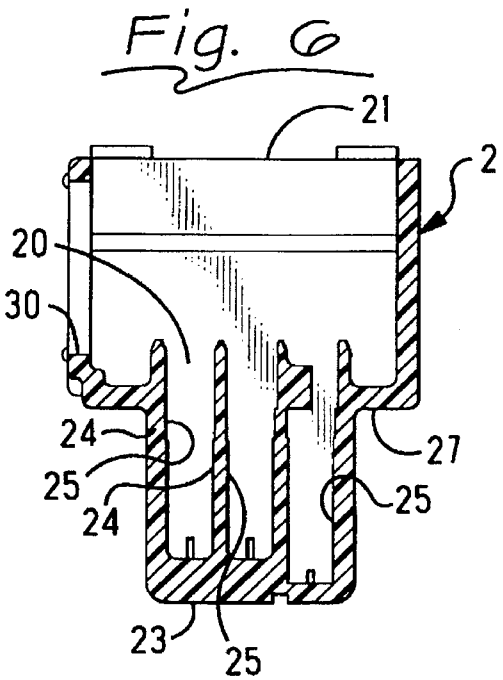
FIG. 6 is a section view through the housing as shown in FIG. 4.
Figure 4:
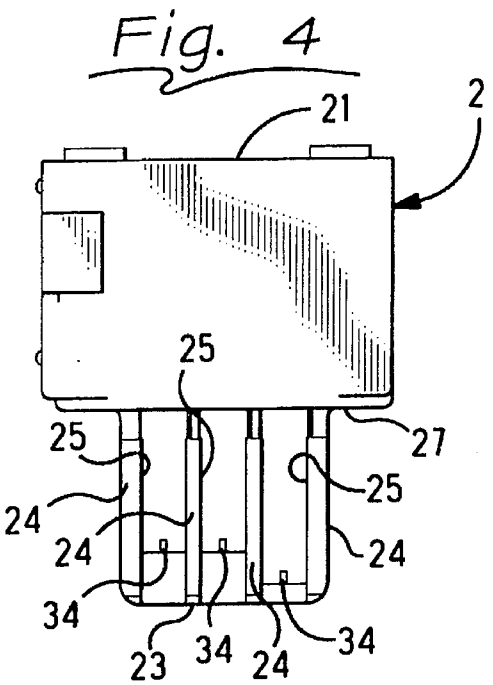
FIG. 4 is a view similar to FIG. 1, of a housing of the connector shown in FIG. 1.
Figure 5:
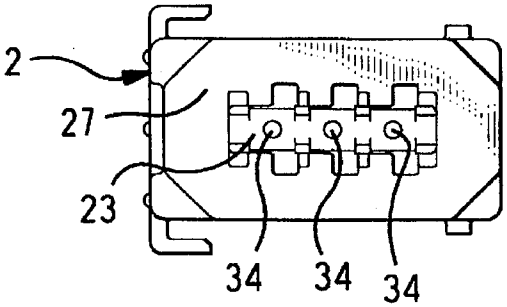
FIG. 5 is an end view of the housing shown in FIG. 4.

Two narrow openings 30 through a bottom wall 31, FIG. 3, of the housing 2, communicate with the interior cavity 20 of the housing 2. The openings 30 extend parallel to the divider 22 and are spaced by an offset 32 from the divider 22. The openings 30 communicate with the open rear 21 of the housing 2, FIG. 3.

A set of contacts 3, as described with reference to FIG. 8, is separated from the carrier strip 9, and remain connected together by the second carrier strip 11. The set of contacts 3 is assembled along one of the sides of the divider 22. Similarly, a second set of contacts 3 is assembled along the opposed side of the divider 22. Assembly of one set of contacts 3 will now be described. With reference to FIG. 2, each set of contacts 3 is assembled in the open rear 21 of the housing 2, and is moved forwardly in the interior of the housing 2 toward the front mating end 23. The rear projections 16 provide tool rests that jut out from the thickness of the contacts 3, and against which a pushing tool, not shown, engages to urge the contacts 3 forwardly. The contacts 3 are laterally supported against the divider 22.

The front projections 15 enter respective contact receiving openings 28 in the front wall 27 on the housing 2. The projections 15 wedge in the openings 28 to retain respective contacts 3 in place, and to urge the contacts 3 against the divider 22. The rear facing edges 18 on the projections 15 lance into the housing 2 to restrain the contacts 3 from rearward movement. Tips 14 on the contacts 3 lodge within respective pockets 26, FIG. 2. The pockets 26 restrain further forward movement of the contacts 3. The pockets 26 prevent lifting of the contact tips 14 from the confines of the channels 25.

The terminals 7 are received along the narrow openings 30 and project through the bottom wall 31 of the housing 2. The offsets 8 on the contacts 3 register against an interior surface of the bottom wall 31, and prevent the contacts 3 from falling through the bottom wall 31. The mating portions 4 on the contacts 3 extend along the channels 25 between the walls 24, and emerge from the front wall 27 on the housing 2. The carrier strip 11 can then be removed.

A feature of the invention will now be described with reference to FIG. 2. To facilitate formation of the channels 25 during a molding operation, slender core pins 33, FIG. 3, register in the front mating end 23 during the molding operation. Each core pin 33 is positioned so as to be between two channels 25 that are formed in opposite sides of the divider 22. The presence of the core pins 33 assures that the channels 25 are formed with precision during the molding operation, and allow the divider 22 to be formed very thin. A thin divider 22 allows formation of a housing 2 in a desirable compact size. When the core pins 33 are removed, core pin openings 34 of small circumferences appear in the mating end 23, FIG. 5. The core pin openings 34 extend until they communicate with the channels 25. The core pins 33 are smaller in circumference than the widths of the channels 25, to prevent falling of tips 14 of the contacts 3 into the core pin openings 34 formed by the core pins 33.

Although a preferred embodiment of the invention is disclosed, other embodiments and modifications of the invention are intended to be covered by the spirit and scope of the accompanying claims.

What is claimed is:

1. An electrical connector of the type having a housing, conductive contacts in the housing having forward sections extending along opposed sides of a divider to contact tips adjacent a mating end of the housing, and shallow channels along the divider receiving forward sections of respective said contacts, the shallow channels being defined by slender core pins during molding, characterized in that:

the mating end includes therethrough core pin openings formed by small core pins during housing molding, said core pin openings communicating with ends of the channels, the small core pins enabling engagement thereagainst by the slender channel-forming core pins for support thereof during molding; the small core pin openings being smaller in circumference than the widths of the channels to prevent falling of tips of the contacts into the openings upon assembly.

2. The connector according to claim 1 wherein pockets are formed at ends of the channels adjacent the mating end, further characterized in that the pockets are defined by angled walls to define an undercut trapping tips of said contacts thereunder upon assembly.

* * * * *